United States Patent [19]

Salem

[11] Patent Number: 4,535,886

[45] Date of Patent: Aug. 20, 1985

[54] FLAT PACKS FOR INCOHERENT PRODUCTS WITH ANTI-CRUSHING DEVICE

[75] Inventor: Emilio Salem, Milan, Italy

[73] Assignee: Novopac S.n.c. dei F.lli Salem E. & O., Italy

[21] Appl. No.: 608,394

[22] Filed: May 9, 1984

[30] Foreign Application Priority Data

Sep. 20, 1983 [IT] Italy ..... 23011B/83[U]

[51] Int. Cl.[3] ..... B65D 75/54; B65D 77/24; B32B 3/00

[52] U.S. Cl. ..... 206/205; 206/216; 206/484; 206/591; 383/38

[58] Field of Search ..... 206/205, 204, 216, 591, 206/521, 484, 814; 383/38

[56] References Cited

U.S. PATENT DOCUMENTS

| | | | |
|---|---|---|---|
| 3,304,219 | 2/1967 | Nickerson | 206/591 |
| 3,410,392 | 11/1968 | Hermanson | 206/205 |
| 4,105,116 | 8/1978 | Jones et al. | 206/484 |
| 4,410,578 | 10/1983 | Miller | 206/204 |
| 4,433,783 | 2/1984 | Dickenson | 383/38 |

*Primary Examiner*—William T. Dixson, Jr.
*Attorney, Agent, or Firm*—Basile, Weintraub & Hanlon

[57] ABSTRACT

A substantially flat flexible wrap for incoherent, flowable products is described, containing inside at least a rigid roundish body which prevents a complete flattening and crushing of the wrap when compressed between substantially flat bodies.

An emission or loss of the flowable products in the wrap is thus avoided.

5 Claims, 2 Drawing Figures

Fig. 1
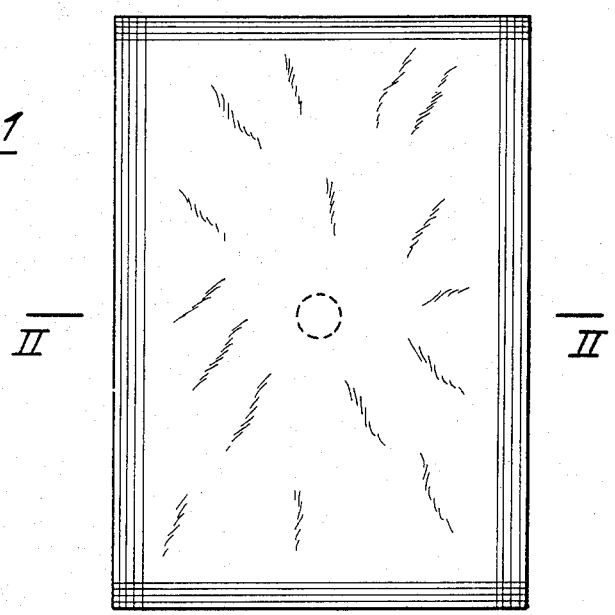
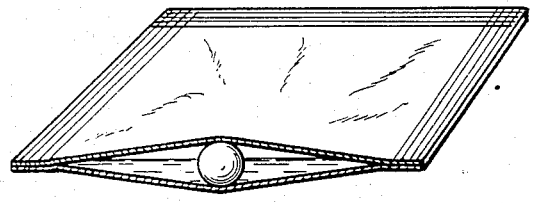
Fig. 2

FLAT PACKS FOR INCOHERENT PRODUCTS WITH ANTI-CRUSHING DEVICE

BACKGROUND OF THE INVENTION

This invention concerns substantially flat packs, such as sachets, pillow packs, bags, etc. hermetically closed containing incoherent products such as liquids, cremes, milks, ointments, powders or objects, equipped with a device that avoids or reduces the possibility of their crushing with consequent loss of product.

DESCRIPTION OF THE PRIOR ART

Various types of flat packages are widely used for edibles, pharmaceuticals, cosmetics or other products either for direct sale as single or multipacks, or as free sampling promotions and as publicity launching inserts into weekly magazines or daily papers sold directly through kiosks.

This particular system of product diffusion presents on the other hand one handicap: the high weight of daily papers or weekly magazines piles containing these sachets can provoke an excessive pressure increase on the hermetically closed contents, with the consequent possibility of damage to the sachets seals or seals rupture ending naturally in leaks, loss of product and damage to the magazines containing them.

SUMMARY OF THE INVENTION

The present invention consequently aims at the elimination of these inconveniences, by introducing a rigid element able to support and absorb the weight and pressure effects of various superposed packages into the sachet or bag filled with an incoherent product.

The introduction of this rigid strengthening element can be effected easily and automatically, before, during or after the product to be protected is introduced into such sachets or bags, etc. and before the final hermetic sealing.

DESCRIPTION OF THE DRAWING

The invention will be better appreciated from the following detailed description of the preferred embodiment in which:

FIG. 1 is a top view of the preferred embodiment with the strengthening element shown in phantom; and FIG. 2 is a cross-sectional view along the II—II line of FIG. 1.

DESCRIPTION OF A PREFERRED EMBODIMENT

Such strengthening element can preferably be constituted according to the present invention, by one or more rigid or semi-rigid small balls made of any adequate material compatible with the product to be packed. Such small balls can consequently be made of metals (for example, in stainless steel), plastics (nylon), glass or other materials, while the sachets or bags, etc. can be made by well-known methods, in paper, plastic, flexible laminates, such as polyester, polyethylene, polypropylene, nylon, polyvinyl-PVC or of metallic foils such as aluminium.

What I claim is:

1. A rupture-proof package comprising:

a plurality of sheet-like members sealed together;

an internal pocket formed from the plurality of sheet-like members the internal pocket containing:

an incoherent material; and at least one support element.

2. The package of claim 1 wherein the support element comprises at least one semi-rigid geometric object.

3. The package of claim 2 wherein the geometric object is a ball.

4. The package of claim 1 wherein the support element is constructed from an inert material.

5. The package of claim 1 wherein the support element is constructed from a material which is compatible with the incoherent material contained in the pocket.

* * * * *